US007484577B2

(12) United States Patent
Overstreet et al.

(10) Patent No.: US 7,484,577 B2
(45) Date of Patent: Feb. 3, 2009

(54) BIT LEG OUTER SURFACE HARDFACING ON EARTH-BORING BIT

(75) Inventors: James L. Overstreet, Tomball, TX (US); Robert J. Buske, The Woodlands, TX (US); John F. Bradford, III, Katy, TX (US); Caleb A. Rickabaugh, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/709,439

(22) Filed: Feb. 22, 2007

(65) Prior Publication Data

US 2007/0163812 A1 Jul. 19, 2007

Related U.S. Application Data

(63) Continuation-in-part of application No. 10/902,222, filed on Jul. 29, 2004, now Pat. No. 7,182,162.

(51) Int. Cl.
*E21B 10/50* (2006.01)

(52) U.S. Cl. ..... 175/374; 175/425

(58) Field of Classification Search ..... 175/374, 175/425

See application file for complete search history.

(56) References Cited

U.S. PATENT DOCUMENTS

| | | | | |
|---|---|---|---|---|
| 3,158,214 | A | 11/1964 | Wisler et al. | |
| 5,791,423 | A | 8/1998 | Overstreet et al. | |
| 6,360,832 | B1 | 3/2002 | Overstreet et al. | |
| 7,182,162 | B2 * | 2/2007 | Beuershausen et al. | 175/374 |
| 2005/0252691 | A1 | 11/2005 | Bramlett et al. | |

FOREIGN PATENT DOCUMENTS

| | | |
|---|---|---|
| WO | WO 99/39075 | 8/1999 |

* cited by examiner

*Primary Examiner*—William P Neuder
(74) *Attorney, Agent, or Firm*—Bracewell & Giuliani LLP

(57) ABSTRACT

An earth-boring bit has bit legs having hardfacing covering the majority of the outer surface. The hardfacing may have gaps at an area surrounding the ball plug and an area around a fixture dimple. The hardfacing may be multi-layer, with the layers differing in composition. Recesses may be located at the leading and trailing edges of the supporting metal so as to provide a thicker area of hardfacing at these corners. The supporting metal of the outer surface of the bit leg may also have an upper cylindrical section and a lower tapered section. The hardfacing has a constant outer diameter but will taper in thickness in the lower tapered section. The thickness of the hardfacing may also vary in a circumferential direction with a greater thickness over at least one of the corners.

19 Claims, 6 Drawing Sheets

BIT LEG OUTER SURFACE HARDFACING ON EARTH-BORING BIT

CROSS-REFERENCE TO RELATED APPLICATION

This invention is continuation-in-part of Ser. No. 10/902,222, filed Jul. 29, 2004 now U.S. Pat. No. 7,182,162.

FIELD OF THE INVENTION

This invention relates in general to earth-boring drill bits and in particular to hardfacing contained on the outer surfaces of the bit legs.

BACKGROUND OF THE INVENTION

A rotating cone drill bit has a body that is typically manufactured from three head sections welded to each other. Each head section has a bit leg with a depending bearing pin for supporting a rotating cone. As the bit turns, the cones rotate to disintegrate the earth formation.

Hardfacing has been applied to portions of the drill bit for many years to resist abrasion. In the prior art, the hardfacing is normally applied to the teeth and gage surfaces of the cones. Also, hardfacing is normally applied to the shirttail of each bit leg. The shirttail is a curved lower end of each bit leg. The hardfacing may also extend upward along one of the leading edges from the shirttail portion for a certain distance.

The bit legs have outer surfaces that are arcuate segments of a cylinder having a diameter slightly less than the gage diameter of the bit. In the prior art, abrasion resistant inserts may be inserted into holes along certain portions of the outer surface to resist abrasion. Typically, these inserts are made of tungsten carbide. While satisfactory, in highly abrasive areas, such as hard sandstones, the supporting metal around each insert may erode so much that the inserts fall out, resulting in extensive wear of the bit body and bit leg failure.

SUMMARY OF THE INVENTION

In this invention, a layer of hardfacing is applied to the majority of the outer surface of each of the bit leg of each of the head sections. The hardfacing extends from the leading edge to the trailing edge and from the lower end of each bit leg to its upper end. The lower end of the bit leg is know as a shirttail; the upper end is at an intersection with a transition area where a lubricant compensator cap normally locates. In the preferred embodiment, the outer surface is free of any hard metal inserts, such as tungsten carbide inserts, rather relies entirely on the hardfacing for resisting abrasion.

Preferably, the hardfacing covers substantially the entire outer surface of the head section. One exception might be if the bit leg is of a type that has a ball plug for retaining locking balls inserted through a ball loading passage to retain the cone. If so, since ball plugs are typically welded in place, normally there will be no hardfacing over the weld.

Another exception to the coverage of the hardfacing on the outer surface might occur with bits of the type that have fixture mounting dimples on the bit leg outer surfaces. While the head sections are being welded together, normally a fixture holds the head sections in position. Preferably the hardfacing has already been applied to the bit legs before the assembly of the head sections. In one manufacturing technique, a small conical depression or dimple is formed in the outer surface of the bit leg of each head section. Not all bits have such dimples, but if so, in the preferred embodiment, the hardfacing does not cover the dimple so as to make it accessible to the fixture. Alternately, a dimple could be machined in the hardfacing.

The hardfacing may be of any known type suitable for earth-boring bits. The hardfacing may be homogenous or graded; for example, the hardfacing may have an underlying coating or sub-layer of a tough, supporting hardfacing, and an outer layer that is harder and more abrasion-resistant than the supporting layer. The multi layer approach is particularly useful for an embodiment wherein portions of the outer surface are machined to an undersized diameter, enabling thicker hardfacing to be applied in those areas than if only a single layer were applied. In one embodiment, a portion of the undersized outer surface section will taper outward to the normal diameter of the supporting metal of a bit leg. The hardfacing on this type of bit will have a constant outer diameter from the upper end to the lower end. However, the thickness of the hardfacing will decrease in the tapered area.

The hardfacing not only covers the outer surface of the bit leg but also extends onto the flank areas adjoining each leading and trailing edge. The corners of the underlying support metal may have a recess, particularly on the leading edge. The recess is filled with hardfacing, providing an area of greater thickness than on remaining portions so as to better resist abrasive wear.

In another embodiment, one or more recesses are formed in the outer surface of the underlying supporting metal of the bit leg. Each recess may be, for example, a cylindrical hole with a closed bottom. The hardfacing fills each recess and covers the outer surface of the bit leg.

In still another embodiment, rather than a recess being formed in the supporting metal at each corner, metal is removed to form a larger radius external corner at the intersections between the outer surface and the leading and trailing flanks. The hardfacing has the desired outer diameter, thus is thicker over the external corners than in the central portion of the outer surface. The thickness of the hardfacing thus varies in a circumferential direction from the leading to the trailing flanks.

DETAILED DESCRIPTION OF THE INVENTION

Figure 1:
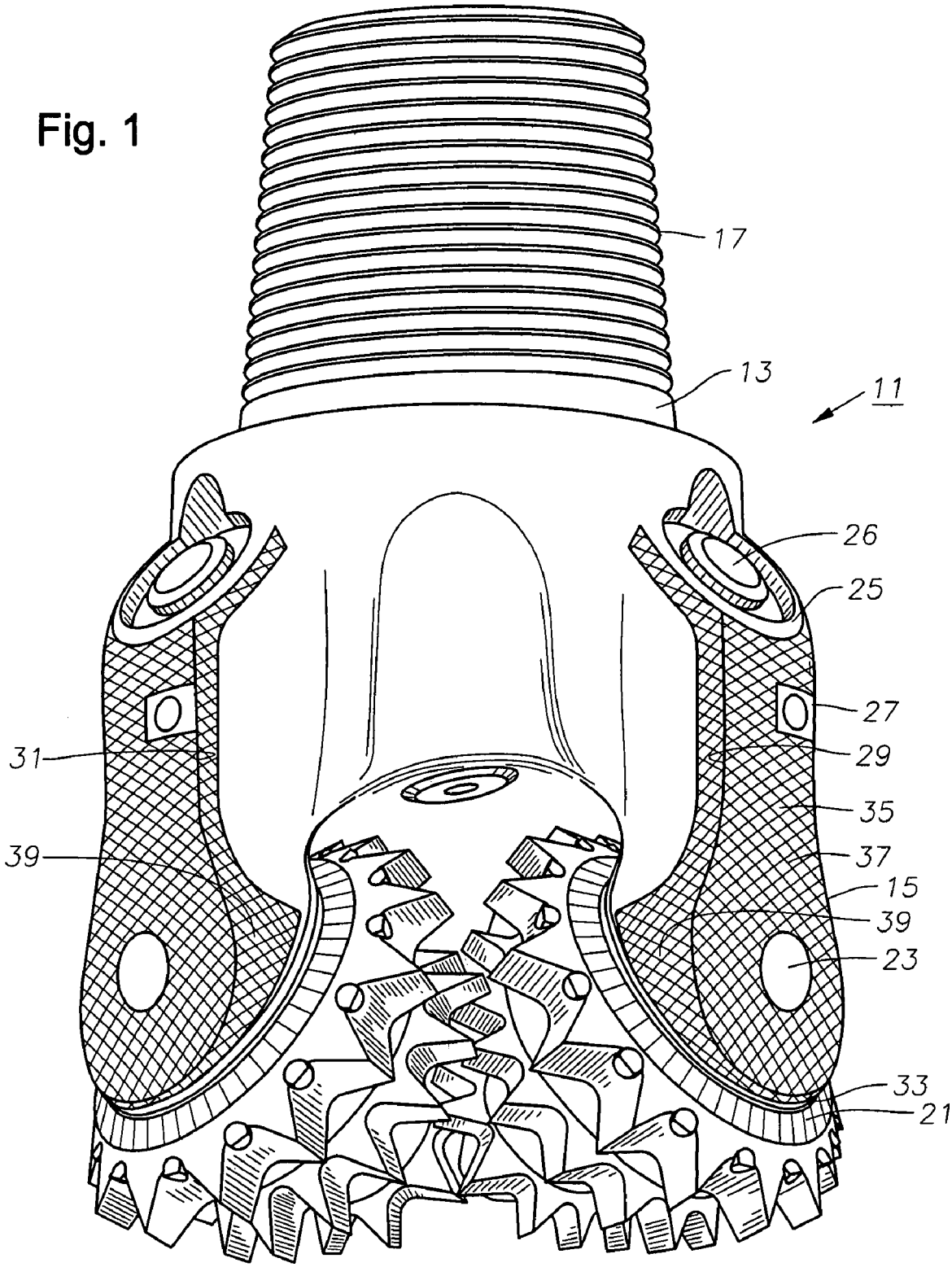
FIG. 1 is a front view of an earth-boring bit constructed in accordance with this invention.
Figure 3:
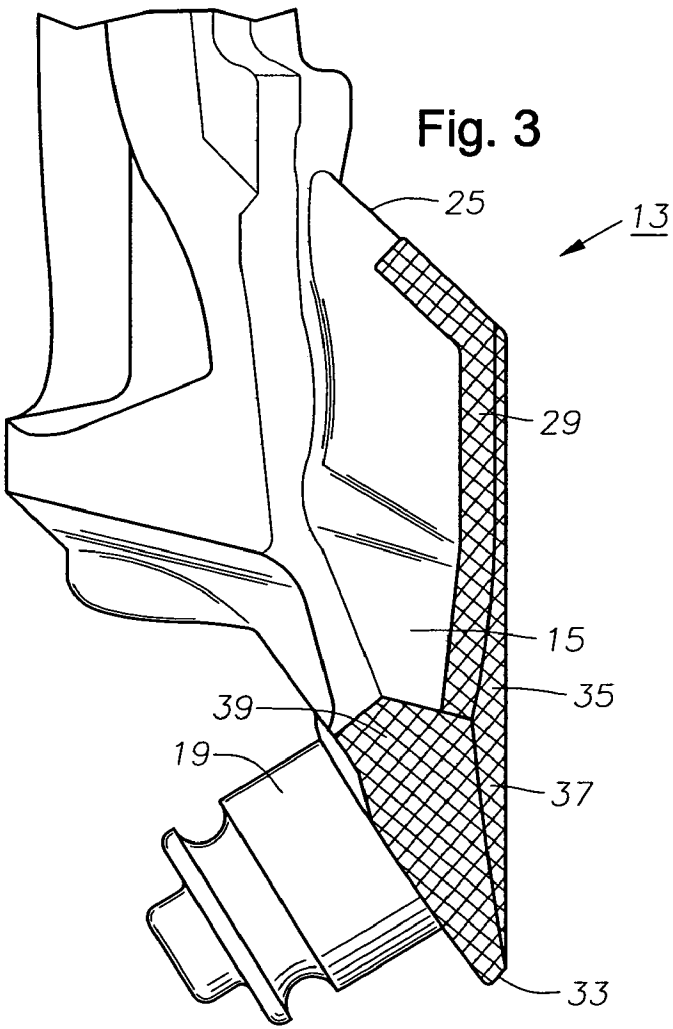
FIG. 3 is a side elevational view of the leading side of the head section of FIG. 2.

Referring to FIG. 1, bit 11 is of a type that has three head sections 13, each having a depending bit leg 15. Head sections 13 are welded to each other, and a threaded section 17 is formed on the upper end. As shown in FIG. 3, each head section 13 has a bearing shaft 19 that depends downward and inward from each bit leg 15. Referring again to FIG. 1, a cone 21 is rotatably mounted to each bearing shaft 19.

Each cone 21 contains a plurality of rows of cutting elements. The cutting elements may comprise teeth machined into the supporting metal of cone 21, as shown in FIG. 1. Alternatively, tungsten carbide inserts may be inserted into mating holes in each cone 21 to form the cutting elements. Cones 21 may be conventional and have conventional hardfacing.

Prior to welding head sections 13 to each other, each cone 21 is inserted on bearing shaft 19 (FIG. 3). In one prior art technique, locking balls are then fed through a passage (not shown) extending into bearing shaft 19 from the outer surface of each bit leg 15. The balls enter mating annular grooves (not shown) extending around bearing shaft 19 to retain cones 21 on bearing shafts 19. A ball plug 23 is then secured over the passage and welded in place.

Many earth-boring rotary cone bits have lubricant sealed between bearing shaft 19 and cone 21. Normally, a pressure compensator will equalize the lubricant pressure with the hydrostatic pressure of the drilling fluid on the exterior. Typically, each head section 13 will have a separate pressure compensator with an external cap 26 that is located in a holes formed in a transition area 25. Each transition area 25 is a generally inclined surface or shoulder that has a lower edge joining the upper end of bit leg 15 and an upper edge joining the portion that forms threaded section 17 (FIG. 1).

While welding the three head sections 13 to each other, they must be assembled into a fixture or jig to hold them in place. In one prior art technique, a dimple 27 is first machined into each head section 13 to facilitate clamping head sections 13 to each other. However, other techniques may not require a fixture dimple 27. In this example, dimple 27 is located on each head section 13 below and nearer transition area 25 than ball plug 23.

Figure 4:
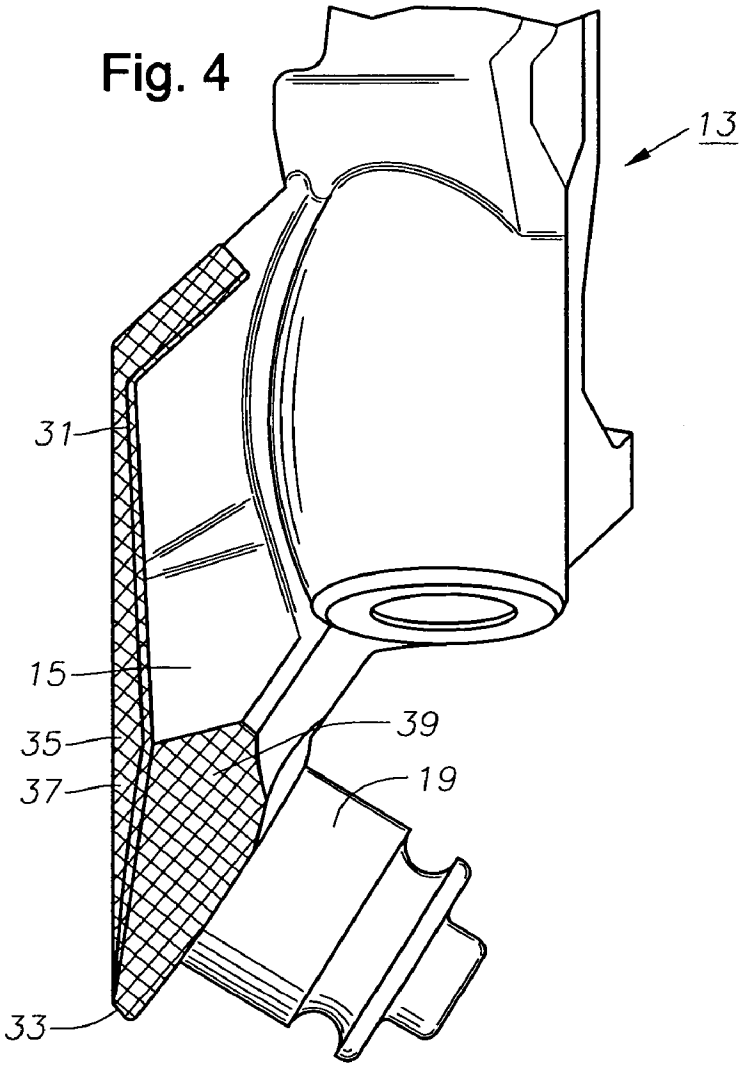
FIG. 4 is a side elevational view of the trailing side of the head section of FIG. 2.

Bit leg 15 of each head section 13 has a leading edge 29 that leads a trailing edge 31, considering the normal direction of rotation of bit 11 while drilling. Each bit leg 15 also has a shirttail 33 at its lower end. Shirttail 33 is a semicircular edge portion that defines the lower end of each bit leg. As shown in FIGS. 3 and 4, each shirttail 33 is a thin section of metal that extends below the intersection of bearing shaft 19 with bit leg 15. Each head section 13 has an arcuate outer surface 35 that is located between leading edge 29 and trailing edge 31 and between shirttail 33 and transition area 25. Outer surface 35 is a segment of a cylinder, and the three outer surfaces 35 define an outer diameter that is less than the nominal gage diameter of bit 11, which is defined by the gage surfaces on cones 21 (FIG. 1).

Figure 2:
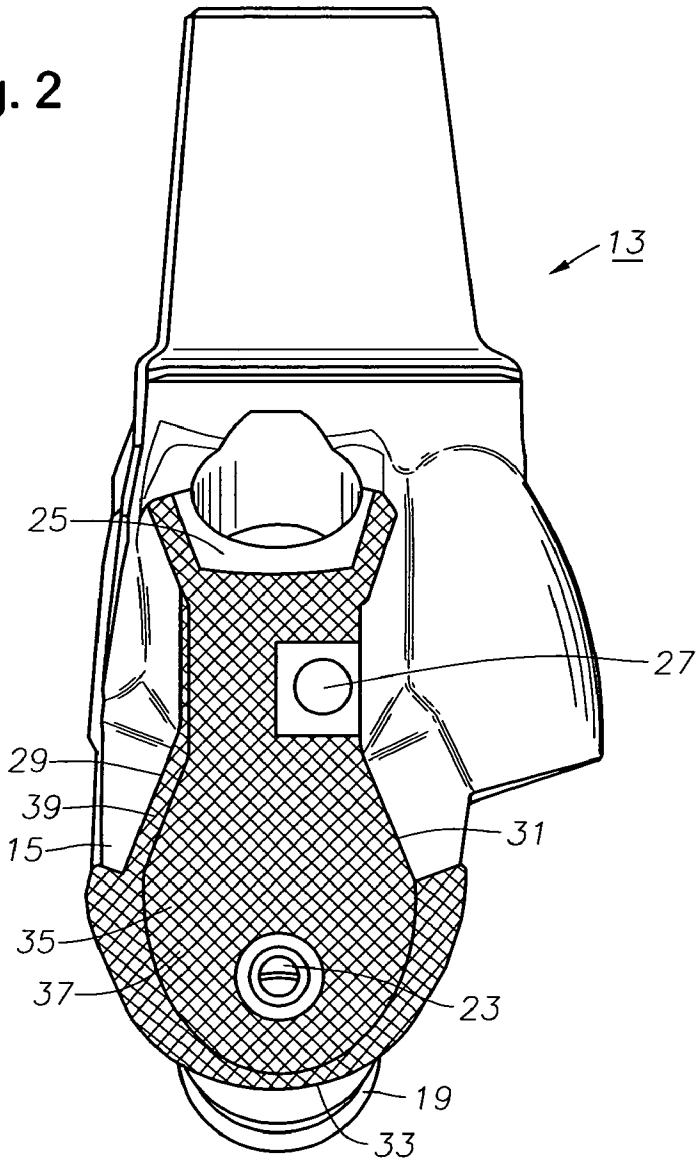
FIG. 2 is a front elevational view of one of the head sections of the earth-boring bit of FIG. 1, and shown prior to being assembled with the other head sections.

In the preferred embodiment, there are no tungsten carbide inserts on outer surface 35 to retard wear. Instead, the majority of outer surface 35 is covered with an outer surface hardfacing 37. Outer surface hardfacing 37 has an exterior that is slightly less than the nominal diameter of bit 11. Outer surface hardfacing 37 typically does not cover a circular area over ball plug 23. Also, if a fixture dimple 27 is formed in the supporting metal of outer surface 35, a gap in outer surface hardfacing 37 may be left. The gap at dimple 27 in this example is rectangular and extends to trailing edge 31, as shown in FIG. 2, but other shapes for the gap are feasible.

Still referring to FIG. 1, each head section 13 may also have flank hardfacing 39 adjacent leading edge 29 and trailing edge 31. Flank hardfacing 39 may extend continuously from shirttail 33 onto transition area 25 on opposite sides of the pressure compensator cap 26 (FIG. 1), if desired. As shown in FIG. 2, even with gaps in outer surface hardfacing 37 at fixture dimple 27 and ball plug 23, the majority of outer surface 35 will contain hardfacing 37. Between fixture dimple 27 and ball plug 23, one portion of outer surface hardfacing 37 extends continuously without interruption from leading edge 29 to trailing edge 31. Also, a portion of outer surface hardfacing 37 extends continuously without interruption on the leading side of ball plug 23 from shirttail 33 onto transition area 25.

Outer surface hardfacing 37 is preferably applied prior to head sections 13 being assembled and welded to each other. In one process, the hardfacing material is applied robotically to outer surface 35. The components of hardfacing 37 are in a granular form and flow down a feed channel into a nozzle in the proximity of an arc. Alternatively, some or all of hardfacing 37 could be applied by torch or by other methods known in the art including high velocity oxygen fuel techniques.

The composition of outer surface hardfacing 37 will vary depending upon application and may be of the same type as previously used for forming hardfacing on shirttails 33 in the prior art. Normally, outer surface hardfacing 37 will have hard, abrasive particles such as tungsten carbide within a matrix material, which may be of iron, steel, cobalt, nickel or alloys and mixtures of them. The tungsten carbide particles may be cast, sintered, macrocrystalline or various combinations. The shapes of the particles may be spherical, irregular or crushed. The various relative quantities of the particles and matrix metal will vary upon applications. The thickness of outer surface hardfacing 37 will vary but is normally in a range from about 0.040 to 0.125 inch or more. After application, the outer diameter of outer surface hardfacing 37 will be slightly less but approximately the bit gage diameter.

Figure 5:
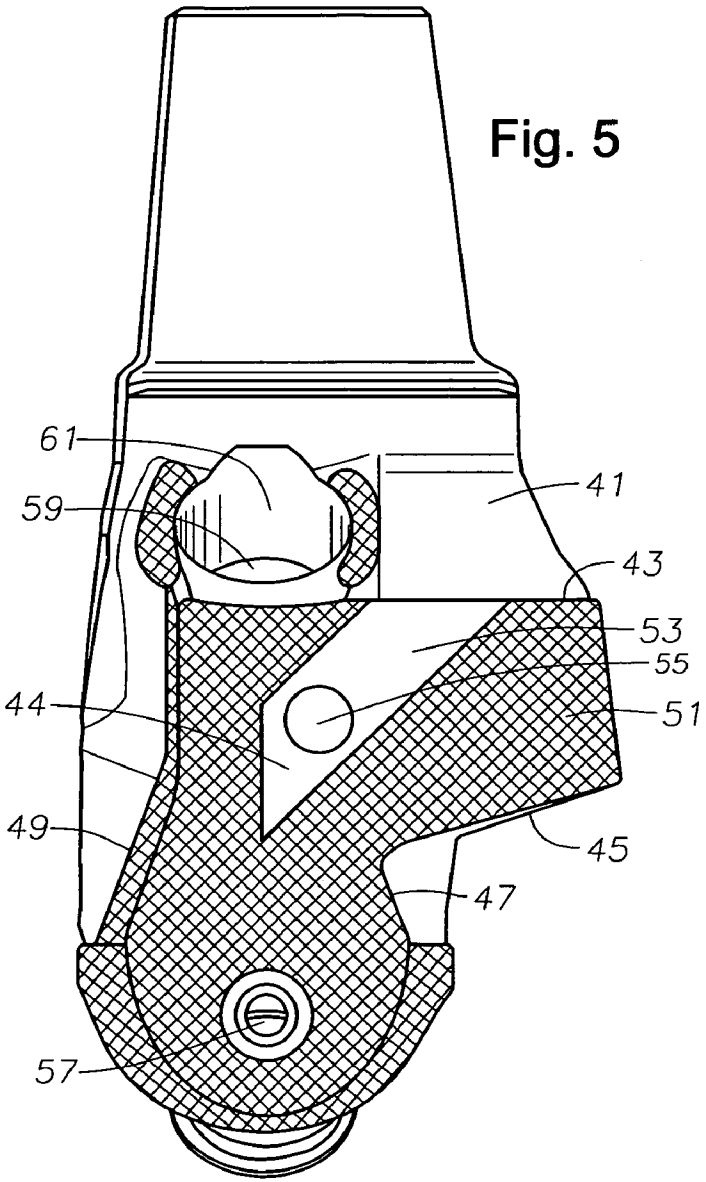
FIG. 5 is a front elevational view of another embodiment of a head section having hardfacing in accordance with this invention.
Figure 6:
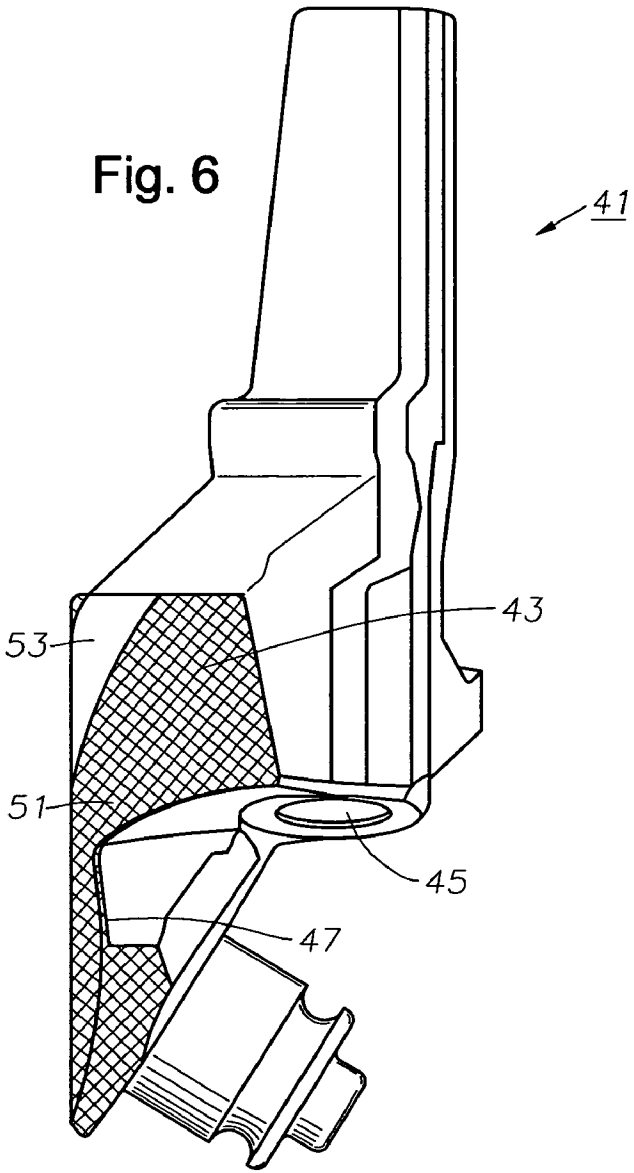
FIG. 6 is a side elevational view of the trailing side of the head section of FIG. 5.

Referring to FIG. 5-6, head section 41 differs from head section 13 (FIG. 1) in that it has a nozzle boss 43. Nozzle boss 43 comprises an arcuate continuation of an upper portion of bit leg outer surface 44 at approximately the same outer diameter for enclosing a nozzle 45. Nozzle boss 43 has approximately the same outer diameter as the remaining portions of outer surface 44, which is initially slightly less than the bit gage diameter. Nozzle boss 43 extends in a circumferential direction from an upper portion of trailing edge 47. Leading edge 49 resembles leading edge 29 (FIG. 2) of the first embodiment.

Rather than tungsten carbide inserts, as in the prior art, outer surface 44, including the portion on nozzle boss 43, is protected by a layer of outer surface hardfacing 51. In the same manner as the first embodiment, outer surface hardfacing 51 covers substantially the entire outer surface 44, except for a dimple area section 53 containing a dimple 55, and a circular section on ball plug 57. In this embodiment, dimple area 53 is rectangular and extends upward at an inclination, rather than being a circumferentially extending rectangular strip as in FIG. 2. In the embodiment of FIGS. 5 and 6, two strips of hardfacing 59 are located on a transition area on the leading and trailing sides of a recess 61 for the pressure lubricant compensator cap.

Figure 7:
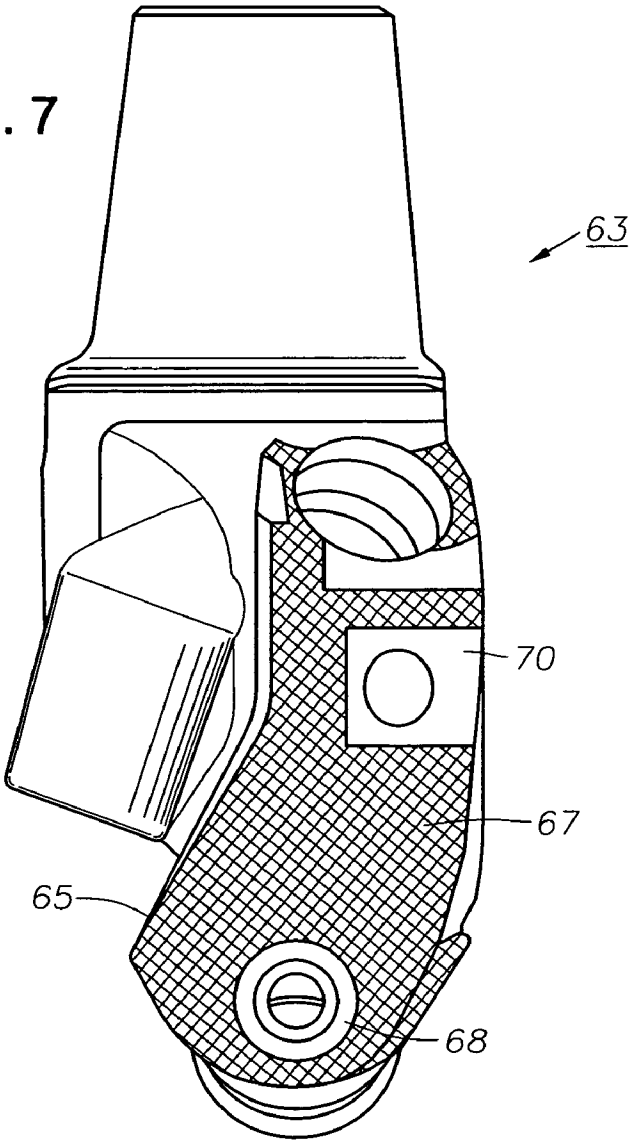
FIG. 7 is a front elevational view of another embodiment of a head section having hardfacing in accordance with this invention.

Referring to FIG. 7, head section 63 is similar to head section 13 of the first embodiment, except that it has an angled bit leg 65 that inclines into the direction of rotation. Bit leg 65 has a layer of hardfacing 67 extending over its bit leg outer surface in the same manner as in the first embodiment. A gap 68 is left in hardfacing 67 for a ball plug. A gap 70 is left in hardfacing 67 for a manufacturing fixture dimple. Gap 70 extends to the trailing edge of bit leg 65 in this example.

Figure 8:
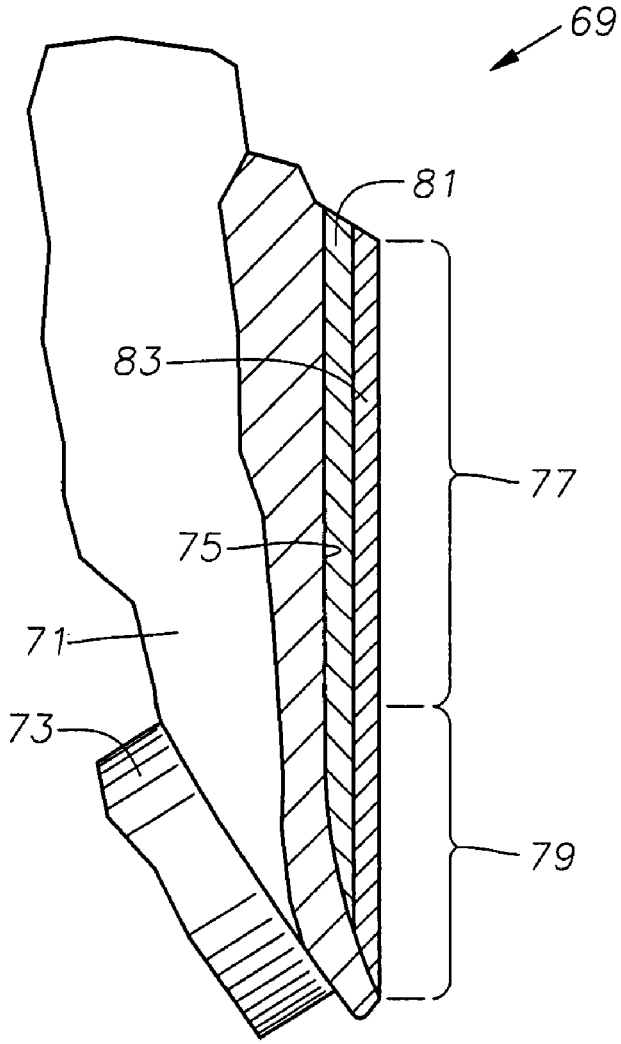
FIG. 8 is a schematic axial cross-sectional view of another embodiment of a head section having multilayer hardfacing in accordance with this invention.

Referring to FIG. 8, head section 69 may be of many types, including types resembling head section 13 (FIGS. 1-4), head section 41 (FIGS. 5-6) or head section 63 (FIG. 7). Head section 69 has a bit leg 71 and a depending bearing shaft 73. Outer surface 75 of bit leg 71 has an upper section that is formed at a diameter that is less relative to the bit gage diameter than the other three embodiments. For example, outer surface 35 of the supporting metal of bit leg 15 of the first embodiment is preferably about 0.040 to 0.125 inch smaller than the gage diameter on a side than the nominal bit gage diameter, so that a single layer of hardfacing 37 will result in slightly less than the gage diameter. In FIG. 8, the difference between the outer diameter of the supporting metal of outer surface 75 and the gage diameter is sufficient to accommodate at least two layers of hardfacing 81, 83, each layer being in the range from about 0.040 to 0.125 inch in thickness.

In the example shown in FIG. 8, the lower portion 79 is curved or tapers generally conically outward to a maximum outer diameter at the lower end of outer surface 75. Underlying coating or layer 81 is preferably of a tougher, more supportive material than exterior layer 83. Exterior hardfacing layer 83 is preferably of more abrasion-resistant material than underlying layer 81. The total thicknesses of layers 81, 83 could be approximately twice that of the outer surface hardfacing of the other embodiments except in lower conical portion 79. The thickness of the combined layers 81, 83 decreases in the lower conical portion 79. In the example shown, a portion at the lower end of lower section 79 has only one of the layers 81, 83 because of the increasing outer diameter of outer surface 75 at the lower end. The outer diameter measured at the exterior of hardfacing layer 83 is substantially constant from the upper end to the lower end and is slightly less than the nominal bit gage diameter.

Making underlying hardfacing layer 81 tougher but less abrasion resistant than exterior layer 83 may be done in various ways known in the prior art. For example, exterior layer 83 may contain a greater density of carbide particles than underlying layer 81. Different densities may be achieved by using particles sizes of different average dimensions. Larger diameter particles result in less density of particles relative to the binder. Although the embodiment described employs hardfacing material with hard particles, such as tungsten carbide, for both hardfacing layers 81, 83, alternately, one of the layers could be a metal that does not have hard particles.

Figure 9:
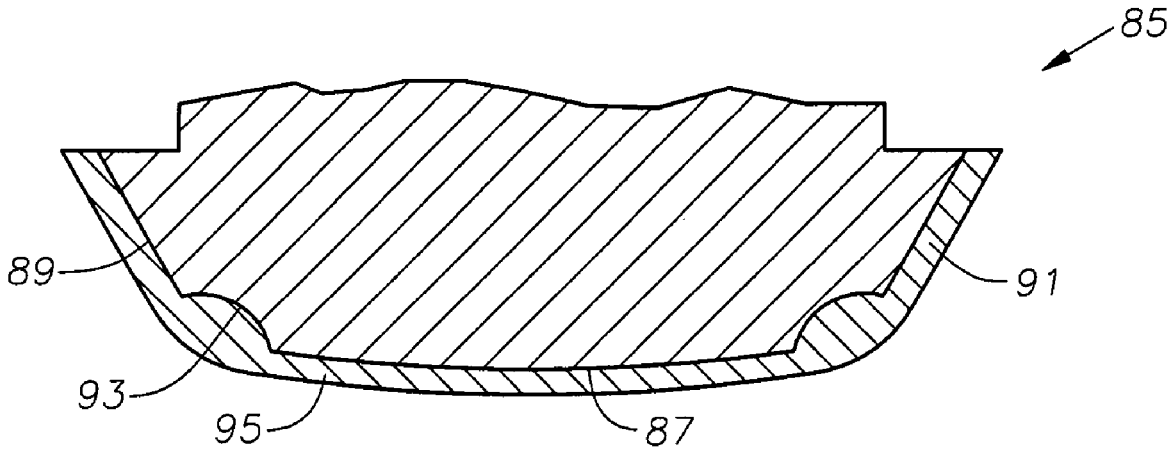
FIG. 9 is a transverse cross-sectional view of a portion of another embodiment of a bit leg, the bit leg having recesses along the corners at the leading and trailing edges, the recesses being overlaid with hardfacing in accordance with this invention.

Referring to FIG. 9, a portion of a bit leg 85 is shown along a sectional plane that is normal to the rotational axis of the bit. Bit leg 85 has an arcuate outer surface 87 that defines an outer diameter slightly less than the bit gage diameter as in the embodiments of FIGS. 1-7 or FIG. 8. Outer surface 87 has a leading flank 89 and a trailing flank 91. Leading and trailing flanks 89, 91 are generally straight inclined surfaces forming obtuse corners with outer surface 87. However, flanks 89, 91 and the obtuse corners between flanks 89, 91 and outer surface 87 could be curved or rounded. A corner recess 93 is formed in the supporting metal of bit leg 85 at the intersection or corner of outer surface 87 with leading flank 89. Corner recess 93 is an arcuate linear depression and extends along leading flank 89 at least part and preferably substantially the full length of bit leg 85. A similar corner recess 93 may be located at the intersection of outer surface 87 with trailing flank 91 as shown. Alternately, corner recess 93 optionally could be located only at the intersection of trailing flank 91 and outer surface 87. Hardfacing 95 covers outer surface 87 and flanks 89, 91. The exterior surface of hardfacing 95 at the corners with flanks 89, 91 comprises an external corner with the same configuration as the embodiments of FIGS. 1-8. Consequently, in the area over corner recesses 93, hardfacing 95 will be of a greater thickness than the hardfacing 95 over the remaining portions of outer surface 87.

Figure 10:
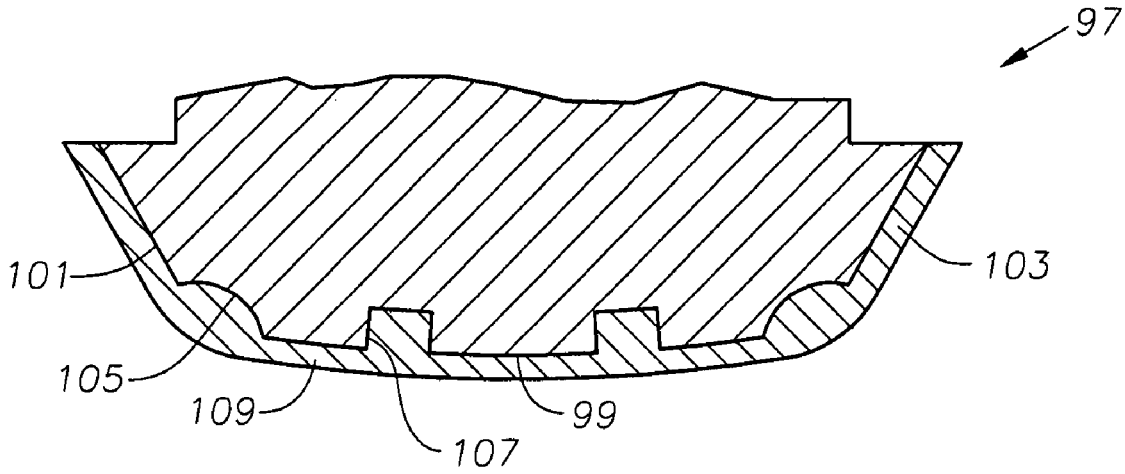
FIG. 10 is a transverse cross-sectional view of a portion of another embodiment of a bit leg, the outer surface of the supporting metal of the bit leg having recesses formed therein, the recesses being filled with hardfacing in accordance with this invention.

Referring to FIG. 10, a portion of a bit leg 97 is shown along a sectional plane that is normal to the longitudinal axis of the bit. Bit leg 97 has supporting metal with an arcuate outer surface 99 that defines an outer diameter less than the bit gage diameter as in the embodiments of FIGS. 1-7 and 9 or FIG. 8. Outer surface 99 has a leading flank 101 and a trailing flank 103. Leading and trailing flanks 101, 103 are generally straight inclined surfaces forming obtuse corners with outer surface 99. However, flanks 101. 103 and the corners could be curved or rounded. A corners recess 105, similar to recesses 93 of FIG. 9, may optionally be located in the supporting metal of bit leg 97 at the intersection of outer surface 99 with either or both flanks 117, 119.

One or more outer surface recesses 107 are formed in the supporting metal of outer surface 99. Outer surface recesses 107 may be a variety of shapes, and are shown to be cylindrical, closed bottom holes. Hardfacing covers outer surface 99 and flanks 117, 119, filling outer surface recesses 107 and corners recesses 105, if employed. In the areas over outer surfaces recesses 107 and corners recesses 107, hardfacing 109 will be of a greater thickness than the remaining portions.

Figure 11:
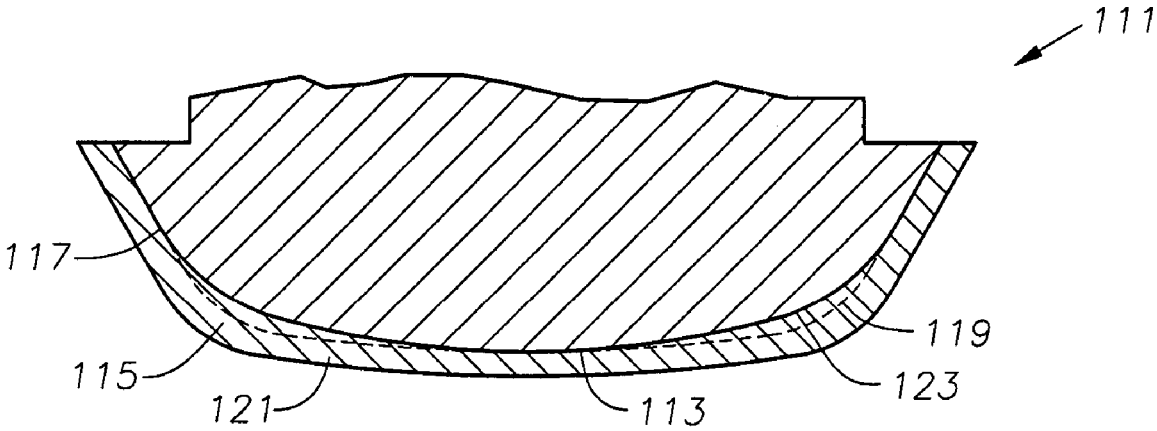
FIG. 11 is a transverse cross-sectional view of a portion of another embodiment of a bit leg, the outer surface of the supporting metal of the bit leg having metal removed at the corners with the leading and trailing edges to cause the hardfacing thickness to vary in a circumferential direction from the leading to the trailing flank in accordance with this invention.

Referring to FIG. 11, a portion of a bit leg 111 is shown along a sectional plane that is normal to the longitudinal axis of the bit. The supporting metal of bit leg 111 has a curved outer surface 113 that was initially in the form shown by the dotted lines 115. Bit leg has a leading flank 117 and a trailing flank 119 and an overlay of hardfacing 121. Prior to applying hardfacing 121, outer surface 113 and flanks 117, 119 are machined to form rounded corners 123, each with radius larger than the original radius indicated by the dotted lines. Hardfacing 121 is applied so as to provide an external contour that is the same as in the other embodiments.

Unlike corners recesses 105 (FIG. 10), corners 123 are external; that is the center point for the radius of each corners 123 is located radially inward from the corners 123. The center points for corners recesses 105 (FIG. 10) are located radially outward from corners recesses 105. The removal of supporting metal, however, creates areas at each corners 123 that have thicker hardfacing 121 than in the central area equidistant between corners 123. The depth of hardfacing 121 thus varies in a circumferential direction around outer surface 113. Hardfacing 121 increases in thickness from leading flank 117 to the central portion of its corners 123, then decreases to a minimum thickness approximately equidistant between flanks 117, 119. From there, hardfacing 121 increases thickness to corners 123 at trailing flank 119, then decreases again on trailing flank 119. The embodiment of FIG. 11 could also be overlaid with multiple layers and have an axially tapered lower section as in FIG. 8.

The invention has significant advantages. It has been found that bits having hardfacing as described have suffered fewer problems due to breakage of bit legs. These bits have proven superior in certain areas to prior bits containing carbide wear-resistant inserts located in the outer surface.

While the invention has been shown in only a few of its forms, it should be apparent to those skilled in the art that it is not so limited, but is susceptible to various changes without departing from the scope of the invention.

We claim:

1. An earth-boring bit comprising:

a bit body comprising a plurality of head sections, each of the head sections having a depending bearing shaft and a bit leg outer surface with a leading edge, a trailing edge, an upper end, a shirttail at a lower end and a central portion located centrally between the upper and the shirttail and between the leading and trailing edges;

a cone rotatably mounted to each of the bearing shafts; and a layer of hardfacing on the outer surface of each of the bit legs, the layer of hardfacing covering the shirttail and also extending from the leading edge to the trailing edge through the central portion.

2. The bit according to claim 1, wherein the layer of hardfacing on each of the bit legs extends over a majority of the outer surface.

3. The bit according to claim 1, wherein:

each of the bit legs has a ball plug and a fixture mounting dimple on its outer surface; and the outer surface of each of the bit legs is substantially covered by the layer of hardfacing both above and below the ball plug from the leading edge to the trailing edge except at the dimple.

4. The bit according to claim 1, wherein at least part of the layer of hardfacing on each of the bit legs comprises an underlying layer and an exterior layer over the underlying layer, the underlying layer being of a different composition than the exterior layer.

5. The bit according to claim 1, wherein at least one of the edges of the outer surface of each of the bit legs has a recess extending along at least part of its length, and the layer of hardfacing fills the recess and creates a greater thickness at the recess than at an adjacent portion of the outer surface.

6. The bit according to claim 1, wherein each of the bit legs has underlying support metal that defines a rounded external corner at each of the leading and trailing edges, and wherein the layer of hardfacing covers the external corners and is thicker over at least one of the external corners than at a central portion of the outer surface between the leading and trailing edges.

7. The bit according to claim 1, wherein the layer of hardfacing on the outer surface of each of the bit legs increases in thickness from the lower end upward for a selected distance.

8. The bit according to claim 1, wherein the layer of hardfacing on the outer surface of each of the bit legs has a thickness that varies in a circumferential direction from the leading edge to the trailing edge.

9. The bit according to claim 1, wherein:

the outer surface of each of the bit legs has an upper trailing edge portion that defines a nozzle boss; and the layer of hardfacing extends over the upper trailing edge portion.

10. An earth-boring bit comprising:

a bit body having an axis of rotation and comprising a plurality of bit legs, each bit leg having a depending bearing shaft on which a cone is rotatably mounted;

a transition surface on the bit body above each bit leg for mounting a lubricant pressure compensator cap;

each bit leg having an outer surface that extends axially from a lower end of each bit leg to the transition surface and extends circumferentially from a leading edge to a trailing edge of each bit leg;

a ball plug on the outer surface of each bit leg; and a layer of hardfacing covering a majority of the outer surface both below and above the ball plug of each of the bit legs.

11. The bit according to claim 10, wherein at least part of the layer of hardfacing on each of the bit legs comprises an underlying layer and an exterior layer over the underlying layer, the underlying layer being of a different composition than the exterior layer.

12. The bit according to claim 10, wherein:

a recess extends linearly along at least one of the leading and trailing edges of each of the bit legs; and the layer of hardfacing fills the recess and is thicker at the recess than on an adjacent portion of the outer surface.

13. The bit according to claim 10, wherein the layer of hardfacing on each of the bit legs has a lower section that increases in thickness from the lower end of the bit leg upward.

14. The bit according to claim 10, wherein the layer of hardfacing on the outer surface of each of the bit legs has a thickness that varies in a circumferential direction from the leading edge to the trailing edge.

15. An earth-boring bit comprising:

a bit body having an axis of rotation and comprising a plurality of bit legs, each bit leg having a depending bearing shaft on which a cone is rotatably mounted;

a transition surface on the bit body above each bit leg for mounting a lubricant pressure compensator cap;

each bit leg having an outer surface that extends axially from a lower end of each bit leg to the transition surface and extends circumferentially from a leading edge to a trailing edge of each bit leg;

a ball plug on the outer surface of each bit leg;

a layer of hardfacing covering a majority of the outer surface of each of the bit legs;

a fixture mounting dimple on the outer surface of each of the bit legs; and wherein the layer of hardfacing has a gap at the fixture mounting dimple.

16. An earth-boring bit comprising:

a bit body having an axis of rotation and comprising a plurality of head sections, each head section having a bit leg with a depending downward and inward extending bearing shaft;

a cone rotatably mounted to each of the bearing shafts;

a transition area on each of the head sections for mounting a lubricant pressure compensating cap;

an arcuate outer surface on each of the bit legs, the outer surface of each of the bit legs having a shirttail at a lower end and an upper end joining the transition area, the outer surface of each of the bit legs having a leading edge and a trailing edge; and a layer of hardfacing formed on the outer surfaces of the bit legs, the layer of hardfacing extending axially from the shirttail to the transition area along the leading edge and extending circumferentially from the leading edge to the trailing edge throughout most of the length of the leading edge.

17. The bit according to claim 16, further comprising:

a ball plug at the outer surface of each of the bit legs; and wherein the layer of hardfacing has a gap at the ball plug.

18. The bit according to claim 16, wherein:

each outer surface has under the layer of hardfacing an outer diameter that decreases from the shirttail upward for a selected distance; and the layer of hardfacing has a thickness that increases from the shirttail upward for the selected distance so as to define on the exterior of the layer of hardfacing a nominally uniform diameter from the shirttail to the transition area.

19. The bit according to claim 16, wherein at least a portion of the layer of hardfacing has an underlying layer, and an exterior layer of different composition.

* * * * *

UNITED STATES PATENT AND TRADEMARK OFFICE

CERTIFICATE OF CORRECTION

PATENT NO. : 7,484,577 B2
APPLICATION NO. : 11/709439
DATED : February 3, 2009
INVENTOR(S) : James L. Overstreet et al.

It is certified that error appears in the above-identified patent and that said Letters Patent is hereby corrected as shown below:

Column 1, line 46, delete “know” and insert --known--
Column 3, line 44, delete “holes” and insert --hole--
Column 6, line 48, delete “corners” and insert --corner--
Column 7, line 11, after “upper” insert --end--

Signed and Sealed this

Twenty-eighth Day of April, 2009

JOHN DOLL
*Acting Director of the United States Patent and Trademark Office*